United States Patent [19]

Scheffer et al.

[11] Patent Number: 4,962,683

[45] **Date of Patent: * Oct. 16, 1990**

[54] ROTARY CUTTER APPARATUS

[75] Inventors: Bruce A. Scheffer, Valparaiso; Eric K. Lo, Portage, both of Ind.

[73] Assignee: Scheffer, Inc., Merrillville, Ind.

[ * ] Notice: The portion of the term of this patent subsequent to Jan. 24, 2006 has been disclaimed.

[21] Appl. No.: 186,372

[22] Filed: Apr. 26, 1988

Related U.S. Application Data

[63] Continuation-in-part of Ser. No. 121,319, Nov. 16, 1987, Pat. No. 4,799,414.

[51] Int. Cl.[5] ..... B26D 1/62

[52] U.S. Cl. ..... 83/103; 83/116; 83/346; 83/348; 83/698

[58] Field of Search ..... 83/103, 116, 346, 348, 83/698, 699, 658, 659, 583

[56] References Cited

U.S. PATENT DOCUMENTS

| | | | |
|---|---|---|---|
| 1,310,922 | 7/1919 | Novick . | |
| 1,746,048 | 2/1930 | Novick . | |
| 1,825,069 | 9/1931 | Kavle . | |
| 1,978,136 | 10/1934 | Kavle . | |
| 2,084,573 | 6/1937 | Cowan . | |
| 2,598,820 | 6/1952 | Neese | 83/348 X |
| 3,277,756 | 10/1966 | Des Jardins et al. . | |
| 3,499,370 | 3/1970 | Kulwicki et al. . | |
| 3,793,918 | 2/1974 | Huffman . | |
| 3,799,022 | 3/1974 | Nagel et al. | 83/583 |
| 3,822,625 | 7/1974 | Obenshain | 83/699 X |
| 3,857,314 | 12/1974 | Gregoire . | |
| 4,143,568 | 3/1979 | Cogswell . | |
| 4,412,467 | 11/1983 | DeSanto . | |
| 4,485,710 | 12/1984 | Schlisio et al. . | |
| 4,640,165 | 2/1987 | McMahon et al. . | |
| 4,699,033 | 10/1987 | Gherardi . | |
| 4,799,414 | 1/1989 | Scheffer et al. | 83/103 |

FOREIGN PATENT DOCUMENTS

| | | | |
|---|---|---|---|
| 787537 | 9/1935 | France | 83/348 |

*Primary Examiner*—Douglas D. Watts
*Assistant Examiner*—Eugenia A. Jones
*Attorney, Agent, or Firm*—Welsh & Katz, Ltd.

[57] ABSTRACT

A variable rotary cutter assembly for transverse cutting of web material as it passes between rotating anvil and knife cylinders includes one or more cutter assemblies selectively positionable on the periphery of the knife cylinder. Various embodiments of the cutter assembly include a pair of pivotally connected block members adapted for releasable mounting on the knife cylinder and carrying an elongated knife blade which is biased outwardly by spring means about a pivot axis parallel to and spaced from the knife blade. The spring means enable a precise predetermined cutting pressure per unit length of the knife blade to be established against the anvil cylinder while enabling self-adjusting movement of the knife blade to accommodate substantial variance in anvil and knife cylinder spacing and knife blade wear. The cutter assemblies may be mounted to effect single or double transverse web cuts, and stripper means are provided to remove trim strips cut from the web by pairs of knife blades.

36 Claims, 5 Drawing Sheets

ROTARY CUTTER APPARATUS

BACKGROUND OF THE INVENTION

This is a continuation-in-part from pending application Ser. No. 121,319, filed Nov. 16, 1987 now U.S. Pat. No. 4,799,414.

The invention relates generally to rotary cutters for cutting web material and the like, and more particularly to a novel self-adjusting rotary cutter apparatus which may be employed with a knife cylinder and associated anvil cylinder to effect single or double trim cuts transversely of a moving web or sheet and which facilitates reduced setup time, easier maintenance and longer knife blade life than has heretofore been attainable.

It is a conventional practice in the printing industry, and particularly in conjunction with web printing presses, to employ a rotary cutter assembly operative to transversely cut the web material received from the printing press. Such rotary cutters generally employ an anvil cylinder and a knife cylinder which are rotatable in timed relation about axes generally transverse to the direction of movement of the paper web and define a nip therebetween through which the web passes from the printing station. The knife cylinder carries one or more cutter assemblies having knife blades operative to cut or sever the web during rotation of the knife cylinder. Such rotary cutters may also be used with sheet printers to cut sheet material to predetermined length prior to passing it to a sheet type printing press.

When employed with web type printing presses, each cutter or knife assembly may carry a single knife blade to effect a single transverse cut through the moving web material, or may carry a pair of spaced knife blades operative to cut the web along parallel lines so as to create a trim or waste strip, termed a chip, between the knife blades which is conventionally removed by means carried by the anvil or knife cylinder.

Known rotary cutter apparatus, and particularly variable rotary cutters for use in the web printing industry, exhibit a number of drawbacks which result in significant economic inefficiencies. For example, one known rotary cutter arrangement supports a pair of knife blades in an elastomeric holder having longitudinal slots which receive the knife blades. The elastomer holder is affixed to the outer periphery of a knife cylinder such that the holder yields during a cutting operation to take up radial inward movement of the cutting knives during engagement with the associated anvil cylinder. See, for example, U.S. Pat. No. 4,640,165. A drawback to such a rotary cutter arrangement is that the elastomeric material tends to take a permanent set after continued use and requires substantial maintenance to replace the blade holder or otherwise make adjustments so as to maintain the desired knifeblade-to-anvil surface relation for efficient cutting. A further significant drawback in this type of rotary cutter arrangement is the inability to accurately adjust and maintain a desired cutting force between the cutting edges of the knife blades and the peripheral surface of the anvil cylinder.

Another known rotary web cutter apparatus supports one or more cutter blades generally longitudinally of a knife cylinder and allows for manual radial adjustment of the blades relative to the knife cylinder during rotation or roll-in of the knife cylinder so as to obtain the desired engagement of the knife blades against the anvil surface. See, for example, U.S. Pat. No. 4,466,319. Such rotary cutter apparatus require substantial setup time to precisely locate the knife blades relative to the anvil surface, and require significant downtime in the event of damage or wear to the knife blades.

As aforementioned, when employing pairs of spaced knife blades to effect parallel cuts transversely of a moving web and thereby create a waste or trim strip between the knife blades, it is desirable to provide means to remove the trim strip. One technique for removing trim strips utilizes a pin wheel operative to introduce generally radial pins between the pairs of knife blades and cause the trim strips to be released during rotation of the knife cylinder. Reliance solely on the use of such pin wheels to remove the trim strips may result in failure of the pin wheel to completely remove a trim strip, thus leaving it between the corresponding knife blades where it is carried into the nip during the next successive web cutting cycle.

Thus, the known rotary web cutter apparatus exhibit a number of drawbacks which lead to operational and economic deficiencies due to the initial setup time required, the frequency of maintenance necessary to maintain proper operation and the relatively high skill level required for setup, maintenance and operation.

SUMMARY OF THE INVENTION

One of the primary objects of the present invention is to provide a novel self-adjusting rotary cutter apparatus for use in cutting web material and the like which overcomes the drawbacks exhibited by prior rotary cutter apparatus.

A more particular object of the present invention is to provide a novel rotary cutter apparatus for use in transverse cutting of web or sheet material, and which enables precise self-adjusting control of the cutting pressure per unit length of the knife blade against the web during a cutting operation.

A further object of the present invention is to provide a rotary cutter apparatus having novel means to enable precise positioning of the knife blade cutting edges relative to the knife cylinder on which the cutter apparatus is carried, and which facilitates relatively quick and precise knife blade replacement without substantial downtime of the rotary cutter apparatus.

A still further object of the present invention is to provide a novel rotary cutter apparatus for use with a web printing machine and the like and which enables relatively rapid and precise setup by an operator having a substantially lower skill level than has heretofore been required, thereby leading to significant economic savings.

Yet another object of the present invention is to provide a novel cutter assembly which may be employed with a rotary knife cylinder to effect single transverse web cuts, or may be employed in symmetrical opposed pairs to effect generally simultaneous double transverse web cuts in which case stripper means are provided to remove the trim or waste strips created between the pairs of knife blades.

A feature of the rotary cutter apparatus in accordance with the invention lies in its ability to self-compensate so as to maintain consistent operating characteristics irrespective of changing conditions in the associated knife and anvil cylinders due, for example, to heat buildup and the like during operation.

A feature of the rotary cutter apparatus in accordance with the invention lies in the provision of a knife blade carrier block member adapted to be pivotally mounted on a knife cylinder for pivotal movement about a pivot axis parallel to and spaced from the knife blade, and which includes means for precisely adjusting the pressure applied by the knife blade against an associated anvil cylinder as a web or sheet is passed through the nip defined between the anvil and knife cylinders, thereby enabling a precise self-adjusting cutting pressure per unit length of knife blade.

A feature of one embodiment of the rotary cutter apparatus in accordance with the invention lies in the provision of one or more base blocks adapted for mounting along the longitudinal length of the knife cylinder, each base block facilitating releasable mounting of one or more cutter assemblies thereon in a manner enabling variable positioning of the cutter assemblies about the knife cylinder without removing them from their associated base block.

Further objects, features and advantages of the invention, together with the organization and manner of operation thereof, will become apparent from the following detailed description of the invention when taken in conjunction with the accompanying drawings wherein like reference numerals designate like elements throughout the several views.

DETAILED DESCRIPTION

Figure 1:
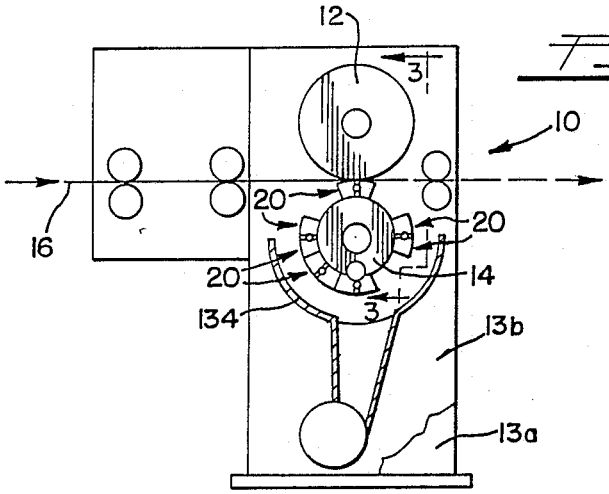
FIG. 1 is a schematic elevational view illustrating a variable rotary cutter arrangement in accordance with the invention in operative association with a web to be cut generally transversely thereof, a portion of the frame structure being removed for purposes of clarity.

Referring now to the drawings, and in particular to FIG. 1, a variable rotary cutter apparatus constructed in accordance with one embodiment of the present invention is indicated at 10. The variable rotary cutter apparatus 10 finds particular application in cutting or perforating a moving web material, such as paper, transversely of its direction of movement so as to cut the web transversely into discrete predetermined lengths or perforate the web to create tear lines at predetermined positions along its length. For example, the rotary cutter apparatus may be employed with a web type printing press operative to effect printing on a movable paper web after which the web may be passed through a folder station and/or a slitter station from which the web material is passed through the rotary cutter apparatus 10.

The variable rotary cutter apparatus 10 includes a cylindrical anvil cylinder 12 which is supported between a pair of upstanding frame members 13*a* and 13*b*. In the embodiment of FIG. 1, the anvil cylinder 12 is supported in overlying relation to a cylindrical knife cylinder 14 which is also supported between the frame members 13*a,b* and cooperates with the anvil cylinder to define a nip between the anvil and knife cylinders through which a continuous web of paper material or the like, indicated at 16, passes preparatory to being cut generally transversely into discrete lengths by the rotary cutter apparatus. The knife cylinder 14 is adapted to have a plurality of cutter assemblies, each of which is indicated generally at 20, mounted on its outer peripheral surface so as to establish transverse cutter means cooperable with the anvil 12 to effect transverse cutting or severing of the web 16. To this end, drive means (not shown) are operatively associated with the anvil and knife cylinders to effect predetermined synchronized rotation relative to each other in opposite rotational directions and in timed relation to the linear speed of the web material 16 as it is fed into the nip between the anvil and knife cylinders.

The number of cutter assemblies 20 and their relative positions about the periphery of the knife cylinder 14 is dependant upon the desired mode of operation of the corresponding printer, such as 2-around, 3-around, 4-around or $\frac{2}{3}$-around printing on the web material in a known manner. It will become apparent that the cutter assemblies 20 may also be employed to transversely cut web material into sheets prior to feeding into a sheet printer, or may be employed as an off-press cutter or inline sheeter. Further, the cutter assemblies 20 may also replace conventional male-female sawtooth cutters as employed in web press folders so as to produce finished straight cuts rather than ragged sawtooth cuts as presently delivered, thus completing the trim operation in the folder and eliminating the cost of postdelivery trimming.

A feature of the cutter assemblies 20 lies in their ability to self-adjust to variances in blade wear and anvil and knife cylinder spacing at the nip while maintaining a predetermined cutting force per unit length of the knife blade against the anvil cylinder. Another feature is the ability to be quickly setup for cutting the web material 16 into different longitudinal lengths depending upon the particular printing "repeat" selected for the corresponding print roll or cylinder. One or more cutter assemblies 20 may be mounted on the peripheral of the knife cylinder 14 to effect a single transverse cut of the web 16 upon each pass of a cutter assembly through the nip defined between the knife and anvil cylinders. Alternatively, the cutter assemblies 20 may be mounted on the knife cylinder in symmetrical pairs at selected positions about the peripheral of the knife cylinder to effect substantially simultaneous double transverse cuts and thereby create waste or trim strips between the respective pairs of knife blades.

Figure 2:
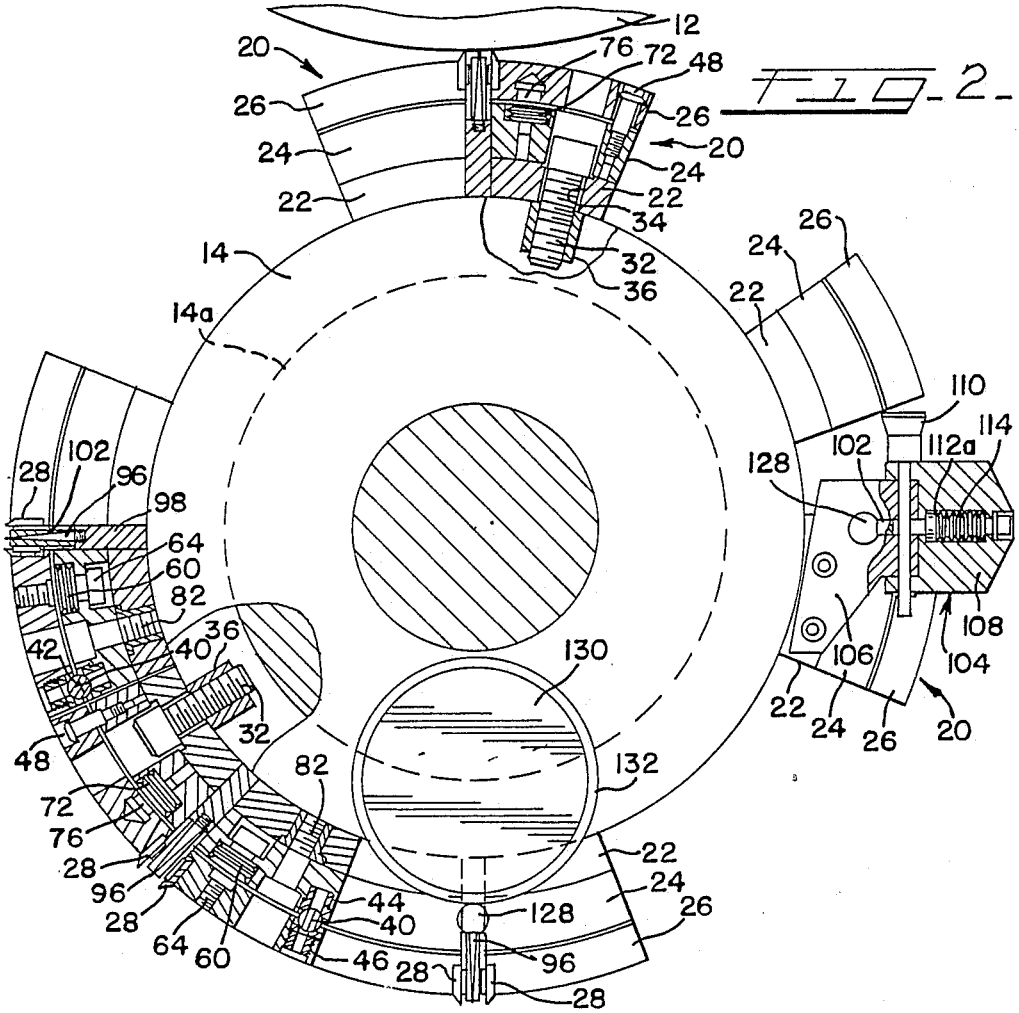
FIG. 2 is an end view of the knife cylinder of FIG. 1 having a plurality of cutter assemblies mounted thereon, portions being broken away and taken in section to illustrate various components of the cutter assemblies.
Figure 3:
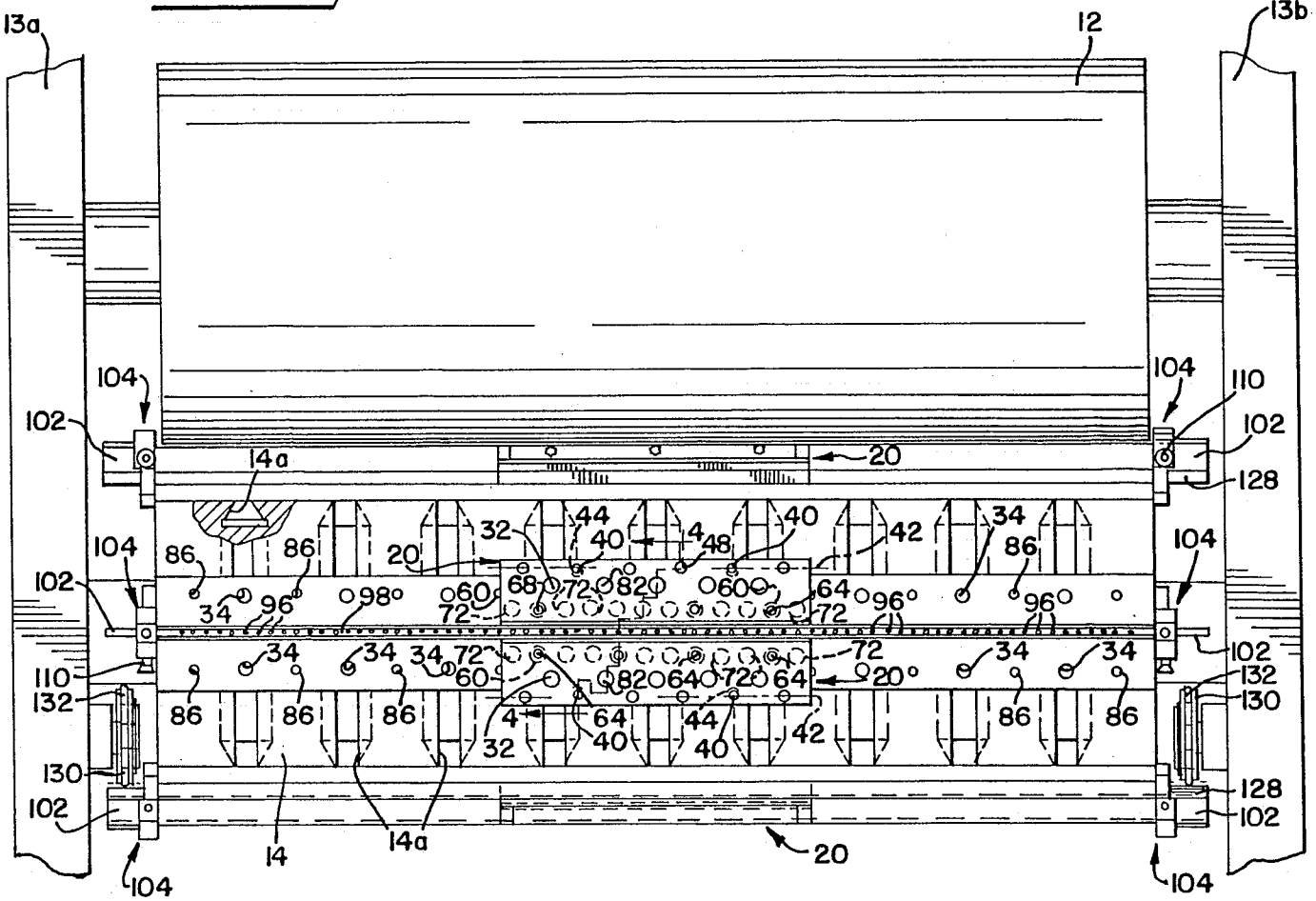
FIG. 3 is a fragmentary elevational view taken substantially along line 3—3 of FIG. 1.
Figure 4:
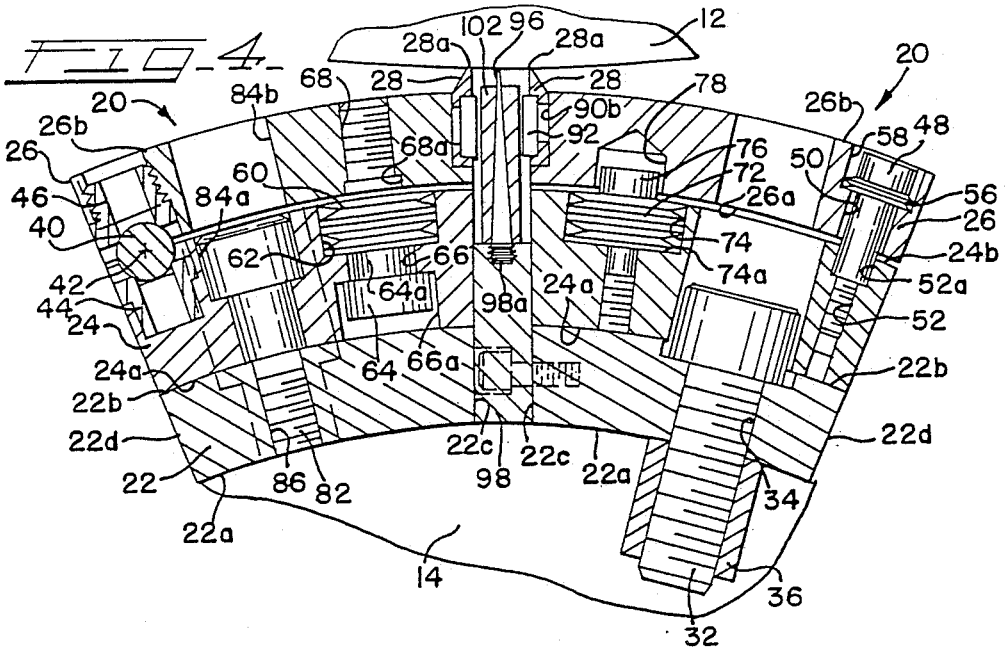
FIG. 4 is an enlarged fragmentary sectional view taken substantially along line 4—4 of FIG. 3 but illustrating the cutter assemblies at the nip position with the anvil cylinder.

Each cutter assembly 20 in the embodiment illustrated in FIGS. 2–4 is mounted on a base block 22 which preferably extends the full longitudinal length of the knife cylinder 14 and facilitates mounting of a plurality of cutter assemblies 20 along its length. The base block 22 is bounded by inner and outer arcuate surfaces 22*a* and 22*b* and generally radial side wall surfaces 22*c* and 22*d*. Each cutter assembly 20 includes a block member or element 24 which is bounded by inner and outer arcuate surfaces 24*a* and 24*b*, respectively, and has side wall surfaces generally coplanar with the side surfaces 22*c,d* of the corresponding base block 22. Each block member 24 is adapted to be releasably mounted on the associated base block 22 and pivotally supports an outer block member or element 26 which, in turn, carries an elongated knife blade 28 having a rectilinear cutting edge 28*a*. As will be described, the knife blade 28 of each cutter assembly 20 is adapted to engage the anvil cylinder and be displaced inwardly toward the axis of the knife cylinder as it passes through the nip during each revolution of the knife cylinder. Each knife blade is biased outwardly against the anvil cylinder so as to effect a predetermined cutting force against the web per unit length of the knife blade.

Turning now to a more detailed description, each base block 22 is adapted to be selectively positioned about the outer cylindrical surface of the knife cylinder through a plurality of cap screws 32 which extend through suitable radial bores 34 in the base block and have conventional dovetail nuts 36 threaded onto their radially inner ends. The nuts 36 are adapted to be inserted into annular dovetail groves 14*a* formed in longitudinally spaced relation along the length of the knife cylinder, and enable releasable locking of the base blocks 22 about the peripheral of the knife cylinder. The block members 24 and 26 will generally be made of shorter length than their associated base block 22 so as to have a longitudinal length slightly greater than the length of cut necessary to sever the full transverse width of the web 16 which may comprise, for example, one or more web strips of approximately 6-inch or 12-inch width. Thus, one or more cutter assemblies 20 may be selectively affixed along the length of each base block 22 depending upon the transverse cutting pattern desired.

As aforementioned, the block member 26 of each cutter assembly 20 is supported on its associated block member 24 through means enabling pivotal movement of each block member 26 relative to its associated block member 24. In the embodiment illustrated in FIGS. 2–4, a plurality of spherical balls 40 are interposed between the block members 24 and 26 so as to define a pivot axis, represented by line 42 in FIG. 3, which passes through the centers of the balls 40 in parallel relation to the rotational axis of the knife cylinder and parallel to the associated knife blade 28 carried by the block member 26. In the illustrated embodiment, two balls 40 are mounted between each pair of block members 24 and 26 spaced equally from the opposite ends thereof. Each ball 40 is seated between a pair of tubular headened bearing seats 44 and 46 mounted in axially aligned relation in the block members 24 and 26. In the illustrated embodiment, the spherical balls 40 and associated bearing seats 44 and 46 are sized to establish approximately 0.030 inch spacing between the block members 24 and 26 at the pivot axis 42.

Each block member 26 is retained in hinged or pivotal relation to its associated block member 24 through a plurality of cap screws 48 received within bores 50 in block member 26 and having threaded engagement with tapped bores 52 formed in block member 24 such that the axes of the cap screws lie in a common plane containing the rotational axis of the knife cylinder 14 and the corresponding pivot axis 42. The bores 50 in block 26 which receive the shanks of cap screws 48 are slightly larger in diameter than the cap screw shanks to enable pivotal movement of the block member 26 about the corresponding pivot axis 42 relative to its underlying block member 24.

As illustrated in FIG. 4, the shank of each cap screw 48 is bottomed within a counterbore 52*a* coaxial with the associated threaded bore 52. A plurality of belleville type springs 56 are captured between the head end of each cap screw 48 and an annular shoulder surface formed at the base of a corresponding counterbore 58. The length of the shank portion of each cap screw 48 and the spring rate of the springs 56 are selected to bias the bearing seats 44 and 46 against the associated balls 40 in sliding relation therewith.

The outer block member 26 of each cutter assembly 20 is biased pivotally outwardly relative to its associated pivot axis 42 by spring means in the form of a series of belleville type springs 60 captured between annular shoulder surfaces at the bases of counterbores 62 formed in the block member 24 and the adjacent inner surface 26*a* of the outer block member. Shoulder bolts 64 extend through bores 66 in the block member 24 coaxial with counterbores 62 and have threaded connection to tapped bores 68 in the corresponding block member 24. The shank portion 64*a* of each shoulder bolt 64 passes through the corresponding annular belleville springs 60 and bottoms against an annular shoulder formed at the base of a corresponding counterbore 68*a* in the block member 24. The longitudinal length of each shank portion 64*a* is selected so that the head of the corresponding shoulder bolt engages an annular shoulder surface at the base of a counterbore 66*a* to limit outward pivotal movement of the block member 24 relative to the block member 26 and establish a uniform spacing between the block members 24 and 26 of approximately 0.030 inch. In this manner, the outer block member 24 is maintained in predetermined parallel spaced relation to the associated block member 26 during rotation of the knife cylinder except when the corresponding knife blade 28 is at the nip position engaging the anvil cylinder 12 during a cutting operation.

Each block member 26 is further biased pivotally outwardly relative to its associated block member 24 by a plurality of belleville springs 72 which are substantially identical to the belleville springs 60 and are captured between an annular shoulder 74*a* of a counterbore 74 within block member 24 and the adjacent inner surface 26*a* of the outer block member. A pilot shaft 76 is captured within a blind bore 78 in the block member 26 coaxial with the counterbore 74 such that the pilot shaft extends through the annular springs 72. As illustrated in FIG. 3, the longitudinal axes of the shoulder screws 64 and associated springs 60 lie in a common plane containing the longitudinal axes of pilot shafts 76 corresponding springs 72 and the axis of rotation of the knife cylinder, such common plane being parallel to the blade knife 28. By inserting the shoulder bolts 64 from the inner surface 26*a* of a block member 26, the initial preload or outward bias of block member 26 relative to its associated block member 26 may be precisely established by the belleville springs 60 and 72 and cannot be altered or tampered with by an operator after the pivotally connected block members 24 and 26 are mounted on an associated base block 22. Alternative types of springs, such as coil compression springs, may be employed rather than the belleville springs 60 and 72 if desired.

Each pivotally connected pair of block members 24 and 26 may be releasably mounted on an underlying base block through cap screws 82 inserted within aligned bores 84*a* and 84*b* in the block members 24 and 26, respectively, such that the cap screws threadedly engage tapped bores 86 in the base block 22 in alternating equidistantly spaced relation to the bores 34. In this manner, an operator may readily and quickly release a pivotally connected pair of block members 24 and 26 from an underlying base block 22 for interchanging with a different length cutter knife blade or to select a different knife cutting pressure. While the base blocks 22 facilitate in-line transverse mounting of a plurality of cutter assemblies 20 along the length of the knife cylinder 14, the cutter assemblies may alternatively be releasably and adjustably mounted directly on the outer surface of the grooved knife cylinder without utilizing a corresponding base block. In such alternative, the radius of the knife cylinder would be made greater to compensate for the radial thickness of the eliminated base block 22, and the bore holes in block member 24 would be sized to enable attachment of the block member to the knife cylinder through the cap screws 32 and dovetail nuts 36.

Figure 5:
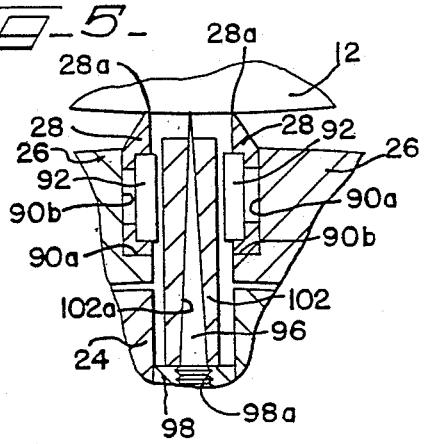
FIG. 5 is a fragmentary vertical sectional view illustrating a pair of opposed knife blades and an intermediate trim stripper pin and stripper bar.

A feature of the cutter assemblies 20 lies in the ability to remove a knife blade 28 from a cutter assembly relatively quickly, and precisely reinstall the knife blade after sharpening or replace the knife blade with another knife blade. Referring to FIG. 5, each block member 26 has a generally rectangular longitudinal recess defined by right angle surfaces 90*a* and 90*b*. The recess surfaces 90*a* and 90*b* serve as reference surfaces to receive and accurately position a rectangular knife blade 28 such that the outer cutting edge 28*a* of the knife blade is precisely positioned relative to the associated block member 26. The knife blades 28 are releasably affixed within the blade recesses 90*a,b* by cap screws 92 which extend through suitable bores spaced longitudinally along the knife blades and have threaded engagement with the corresponding block member 26. In the illustrated embodiment, each knife blade 28 is positioned to establish a maximum interference with the outer cylindrical surface of the anvil cylinder of approximately 0.025 inch.

A further feature of the rotary cutter apparatus 10 lies in the provision of means for removing trim strips created between pairs of knife blades 28 when employing one or more pairs of symmetrically mounted cutter assemblies 20 on the knife cylinder as illustrated in FIGS. 3 and 4. In the embodiment illustrated in FIGS. 2–6, a plurality of generally conical stripper pins 96 are supported in aligned spaced relation along a stripper pin support bar 98 which is affixed to a trailing radial side surface 22*c* of the base block 22 of the lead cutter assembly 20 of each pair of cutter assemblies. The stripper pin support bar 98 extends the full longitudinal length of the associated base block 22 and has a plurality of spaced tapped bores 98*a* to threadedly mount the stripper pins 96 such that the longitudinal axes of the stripper pins extend in radial relation to the rotational axis of the knife cylinder and are generally equally spaced along the support bar. The outer tips of the stripper pins 96 are preferable formed with 4-pronged fork ends positioned so that the tips never extend radially outwardly beyond a plane defined by the cutting edges 28*a* of the corresponding knife blades during a cutting operation. In this manner, when the knife blades 28 are depressed during web cutting engagement with the anvil cylinder, the trim strip cut from the web is impaled by the underlying stripper pins and carried away from the nip area.

Figure 6:
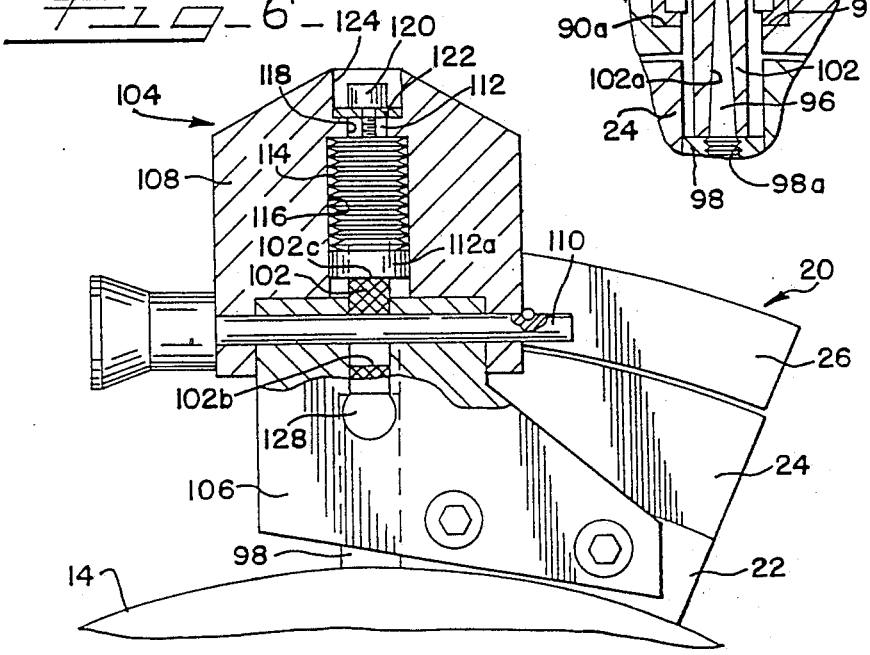
FIG 6 is an enlarged fragmentary view taken from the end of the knife cylinder and illustrating a trim stripper bar biasing means.

A stripper bar 102 is supported on the radial outer surface of each stripper pin support bar 98 to assist in ejecting cut trim strips impaled and carried by the stripper pins 96 when the stripper pins reach approximately the 6-O'clock position during rotation of the knife cylinder The stripper bar 102 has generally conical or cylindrical bores 102*a* located to receive the stripper pins 96 therethrough. Referring to FIGS. 3 and 6, each stripper bar 102 extends outwardly beyond the opposite ends of the knife cylinder 14 and is resiliently biased against the outer surface of the associated pin support bar 98 by biasing means, indicated generally at 104, mounted on the opposite ends of the corresponding base block 22 outboard of the ends of the knife cylinder as illustrated in FIG. 3.

Each stripper bar biasing means 104 includes a support bracket 106 which is suitably affixed to the outer end surface of the corresponding base block 22 and supports a spring housing 108 through a releasable retainer pin 110 which extends through an elongated opening 102*b* in the outer extension of the corresponding stripper bar. The opposite outwardly extending ends of the stripper bar 102 each have a recessed surface 102*c* against which the enlarged head 112*a* of a pilot shaft 112 is biased by spring means in the form of a plurality of annular belleville springs 114 received over the pilot shaft and captured between the head 112*a* and an annular shoulder formed at the base of a bore 116 within the spring housing 108. The pilot shaft 112 is longitudinally slidable through a bore 118 formed in the spring housing coaxial with the bore 116. A cap screw 120 is affixed to the upper end of the pilot shaft 112 and secures an annular washer 122 against the end of the pilot shaft. The washer 122 and cap screw head are received within a counterbore 124 in the spring housing 108. In this manner, radial inward movement of the head 112*a* of a pilot shaft 112 against the corresponding recessed stripper bar surface 102*c* under the influence of the springs 114 is limited by the washer 122.

The radial inner edge of each outwardly extending end of the stripper bar 102 preferably has a rounded lobe 128 affixed thereon for engagement with a circular cam wheel or hub 130 which is rotatably supported by an associated one of the frame members 13*a* or 13*b* such that the axes of rotation of the cam wheels lie substantially in a plane containing the rotational axes of the anvil and knife cylinders 12 and 14, that is, at the 6-

O'clock position of rotation of the knife cylinder as illustrated in FIG. 2. Each of the cam wheels 130 preferably carries an elastomeric O-ring 132 about its peripheral surface positioned to be engaged by the lobe 128 on the corresponding end of the stripper bar 102 as it passes through the 6-O'clock position during each revolution of the knife cylinder. The cam wheels 130 and associated O-rings are positioned to effect a predetermined radial outward movement of each stripper bar 102 as it passes through the 6-O'clock position so as to strip the previously cut trim strip from the corresponding stripper pins 96. The stripped trim strips or chips may then be drawn into a waste receptacle or chamber through a vacuum hood 134 as illustrated schematically in FIG. 1.

Having thus described the variable cutter assembly 10, it will be apparent that the cutter assemblies 20 may be affixed to the periphery of the knife cylinder 14 so as to effect single transverse cuts of the moving web 16 or, alternatively, may be mounted in symmetrical pairs to effect substantially simultaneous cutting of parallel transverse cuts of the web as each pair of cutter blades 28 passes through the nip between the knife and anvil cylinders. As previously described, the cutting edges 28*a* of the knife blades 28 are positioned to engage the web against the anvil cylinder and be depressed radially a predetermined distance, such as 0.025 inch, with resultant severing of the web. By supporting the knife blades 28 for pivotal movement about their corresponding pivot axes 42 against the force of the biasing springs 60 and 72, all interference with the anvil cylinder is accommodated by self-adjusting pivotal movement of the knife blade with the result that damage to the knife blades upon impacting the anvil cylinder is substantially eliminated thereby leading to significantly longer knife blade life. Such self-adjustment of the knife blades accommodates variances in blade wear and anvil and knife cylinder spacing at the nip while maintaining the desired predetermined cutting pressure per unit length of the knife blades against the anvil cylinder.

Figure 7:
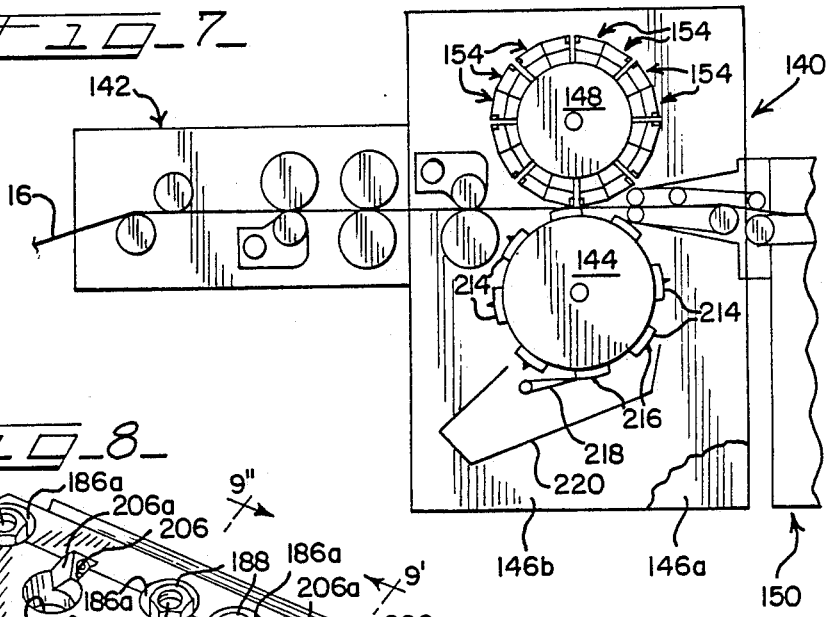
FIG. 7 is a schematic elevational view similar to FIG. 1 but illustrating an alternative embodiment of a variable rotary cutter arrangement in accordance with the invention.

FIG. 7 schematically illustrates an alternative and preferred embodiment of a variable rotary cutter apparatus, indicated generally at 140, in accordance with the present invention. The variable rotary cutter apparatus 140 is generally similar to the aforedescribed rotary cutter apparatus 10 in that it finds particular application in cutting or perforating a moving web material, such as a paper web as indicated at 16, transversely of its direction of movement so as to cut the web into discreet predetermined lengths or perforate the web to form tear lines at predetermined positions along its length. In the embodiment illustrated in FIG. 7, the web material is passed through a web infeed/slitting module 142 of conventional design downstream from a printing press or the like The web material passes from the infeed/slitting module 142 through the rotary cutter apparatus 140 which includes a cylindrical anvil cylinder 144 supported between a pair of upstanding frame members 146*a* and 146*b*. The frame members also support a knife cylinder 148 in vertically aligned overlying relation to the anvil cylinder 144. The anvil cylinder 144 and knife cylinder 148 define a nip therebetween through which the continuous web 16 passes while being cut transversely into discreet lengths or perforated to form transverse tear lines. From the rotary cutter apparatus, the cut lengths of web material may be passed through a skate delivery module of known design, indicated generally at 150, or, alternatively, through an optional tape delivery module for signature type products.

The knife cylinder 148 carries a plurality of cutter assemblies, each of which is indicated at 154, dependent upon the desired mode of operation of the corresponding printer, such as 2-around, 3-around, 4-around or ⅔-around printing on the web material in a known manner. The cutter assemblies 154 may also be employed to cut web material transversely into sheets prior to feeding into a sheet printer, or may be employed as an off-press cutter or in-line sheeter or, still further, the cutter assemblies 154 may be employed in web press folders so as to produce finish straight cuts rather than ragged saw tooth cuts, thus completing the trim operation in the folder and eliminating the cost of post-delivery trimming.

Figure 8:
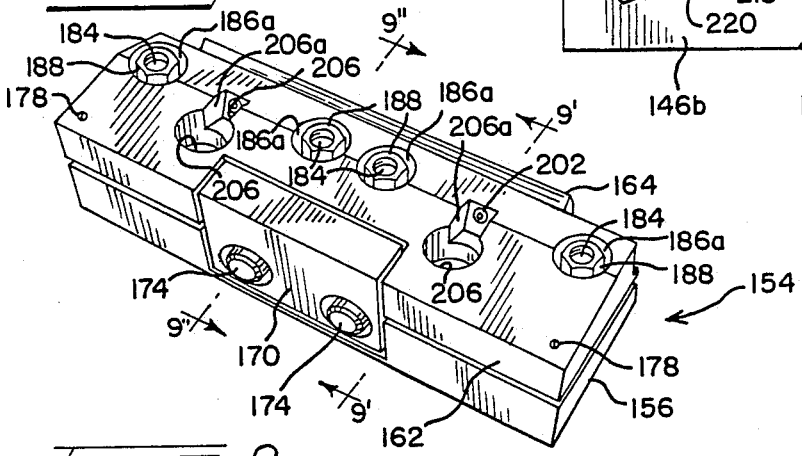
FIG. 8 is a perspective view of a cutter assembly as employed in the rotary cutter arrangement of FIG. 8.
Figure 9:
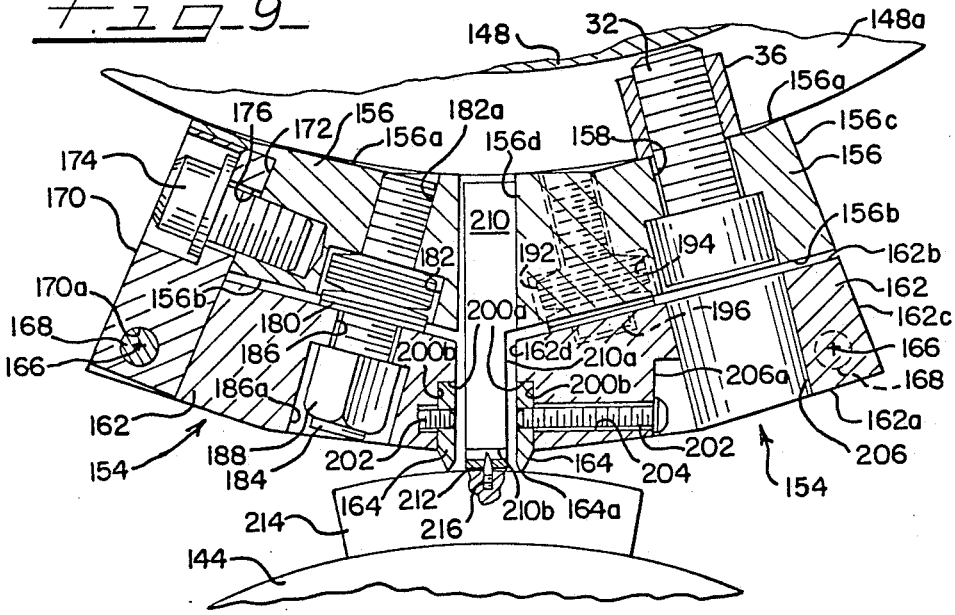
FIG. 9 is a fragmentary transverse sectional view illustrating a pair of the cutter assemblies of FIG. 8 mounted in symmetrical relation on a knife cylinder, the right-hand section of the cutter assembly being taken substantially along line 9'—9' of FIG. 8, and the left-hand section being taken substantially along line 9''—9'' of FIG. 8.
Figure 10:
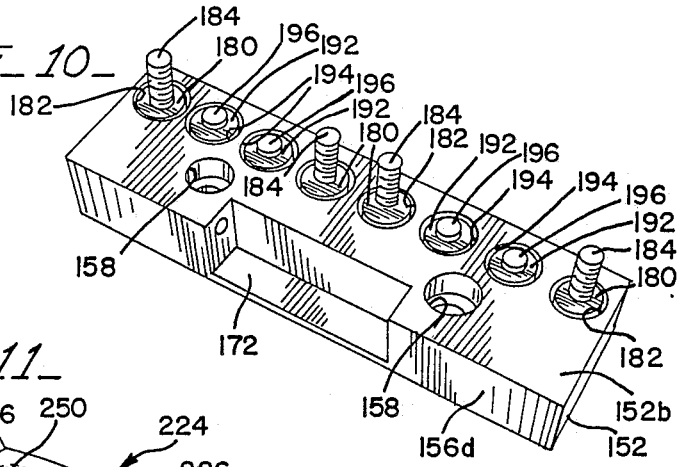
FIG. 10 is a perspective view of the cutter assembly of FIG. 8 but with the block member and hinge block removed.

Referring to FIGS. 8–10, each cutter assembly 154 includes an elongated block member or element 156 which is bounded by an inner surface 156*a* defined by intersecting planar surfaces which closely resemble an arcuate surface of a radius equal to the radius of the knife cylinder 148. An opposite outer surface 156*b* of the block member 156 is planar and lies generally in a plane transverse to a radius which extends from the rotational axis of the knife cylinder 148 and intersects surface 156*b* generally intermediate its transverse width. The block member 156 has planar longitudinal side wall surfaces 156*c* and 156*d* which lie in planes generally radial to the rotational axis of the knife cylinder when block member 156 is mounted on the knife cylinder.

To facilitate selective releasable mounting of a plurality of cutter assemblies 154 on the knife cylinder 148, a plurality of longitudinally spaced annular dovetail grooves are formed about its periphery similar to the aforedescribed grooves 14*a* in knife cylinder 14. Each block member 156 has a pair of counterbored bores 158 formed therethrough sized and spaced apart sufficiently to enable attachment of the block member to the knife cylinder through cap screws 32 and associated dovetail nuts 36 inserted within selected dovetail slots in the knife cylinder.

Each cutter assembly 154 further includes a second block member or element 162 which supports an elongated knife blade 164 and is mounted on the associated block member 156 for pivotal movement about a pivot or hinge axis 166 parallel to and spaced from the knife blade 164. The block member 162 is bounded by an outer surface 162*a* and an inner planar surface 162*b* which is normally generally parallel to the opposed planar surface 156*b* on block member 156. The block member 162 has longitudinal side surfaces 162*c* and 162*d* which are substantially coplanar with the side surfaces 156*c* and 156*d*, respectively, of block member 156.

In the embodiment illustrated in FIGS. 8–10, the hinge axis 166 is defined by an elongated hinge pin 168 which extends through and is rotatable within a bore 170*a* formed longitudinally through a rectangular hinge block 170. The hinge block 170 is received within a rectangular recess 172 formed midlength of the block member 156 and is releasably fixed to block member 156 through a pair of cap screws 174. The shanks of the cap screws 174 extend through counterbored bores 176 in the hinge block which are of slightly larger diameter than the cap screw shanks so as to allow adjustment of the gap between the block members 156 and 162 adjacent the hinge block. The hinge block 170 is also received within a rectangular recess formed midlength of the block member 162 which has longitudinal bores axially aligned with the hinge block bore 170*a* to receive the opposite ends of the hinge pin 168. Set screws 178 are preferably mounted within the block member 162 to engage and prevent longitudinal movement of the hinge pin.

The second block member 162 of each cutter assembly 154 is biased outwardly about its hinge axis 166 relative to the associated block member 156 by biasing means similar to the biasing means acting between the block members 24 and 26 of the cutter assemblies 20. To this end, a series of belleville type springs 180, alternatively termed disk springs, are interposed between the block members 156 and 162 so as to bias the block members to spaced apart relation. In the embodiment illustrated in FIG. 10, a predetermined number of belleville springs 180 are supported within each of four counterbores 182 formed in the surface 156*b* of block member 156 such that the springs are freely received coaxially over threaded stud shafts 184 which are threadedly affixed within tapped bores 182*a*. The outer threaded ends of the stud shafts 184 extend through suitable bores 186 in block member 162 and have lock nuts 188 mounted thereon within corresponding counterbores 186*a*.

The outer block member 162 of each cutter assembly 154 is also biased outwardly about its pivot axis 166 by belleville springs 192 which are received within four counterbores 194 formed in the block member 156 such that the axes of the counterbores 182 and 194 lie in a common plane parallel to the pivot axis 166 and are spaced equidistantly apart. The belleville springs 192 are freely received over corresponding pilot shafts 196 which have threaded connection to the block member 156 coaxially within the counterbores 194. The belleville springs 180 and 192 act against the planar surface 162*b* of block member 162 such that selective adjustment of the lock nuts 188 establishes predetermined spacing between the mutually opposed surfaces 156*b* and 162*b* and effects a corresponding predetermined biasing force tending to pivotally separate the block members 156 and 162. Alternatively stated, for a predetermined setting of the lock nuts 188, a predetermined force is required to pivot the block member 162 about its pivot axis 166 toward the associated block member 156. As aforementioned, alternate types of biasing springs, such as coil compression springs, may be employed rather than the belleville springs 180 and 192. A feature of the cutter assemblies 154 is that the lock nuts 188 are accessible through the outwardly opening counterbores 186*a* to enable an operator to more readily effect initial set-up and, if necessary, make subsequent adjustments without removing the associated cutter assembly from the knife cylinder.

The knife blades 164 are similar to the aforedescribed knife blades 28 and are positively seated against right angle planar surfaces 200*a* and 200*b* which define a rectangular recess at the outer longitudinal corner of the corresponding block member 162. Each knife blade 164 may be formed with a rectilinear cutting edge 164*a*, or may have a serrated or stepped cutting edge for forming a non-continuous perforation transversely of a web material 16 passed through the rotary cutter assembly 140. The knife blades 164 are secured on their corresponding block member 162 so as to facilitate quick release and remounting or replacement as when servicing or replacing worn knife blades. Referring to FIG. 9, each knife blade 164 is releasably retained in positive relation against the corresponding recess surfaces 200*a* and 200*b* by a pair of knife hold-down screws 202 which are received within bores 204 in the block member 162 and have threaded engagement with suitable threaded bores formed in the associated knife blade. The head of each knife hold-down screw is disposed within a recess 206*a* which intersects a corresponding bore 206 formed in the block member 162 to provide access to a corresponding mounting cap screw 32. In this manner, the knife hold-down screws 202 may be readily accessed to quickly release the associated knife blade, thus minimizing the down time to release and replace a knife blade as heretofore required with prior rotary cutters.

The cutter assemblies 154 may be mounted about the periphery of the knife cylinder 148 in opposed generally symmetrical pairs similar to the aforedescribed cutter assemblies 20. In this manner, each symmetrical pair of cutter assemblies 154 cuts the web material along parallel cut lines which create a waste strip or chip between the opposed knife blades. In the embodiment illustrated in FIGS. 7 and 9, stripper means for removing the waste strips or chips includes a generally rectangular spacer bar 210 releasably secured to a longitudinal side surfaces 156*d* of a selected one of the opposed block members 156. The spacer bar 210 is recessed at 210*a* for clearance purposes and has an outer radial edge surface 210*b* parallel to the rotational axis the knife cylinder and spaced radially inwardly from a plane containing the knife blade cutting edges 164*a*. The edge surface 210*b* is stepped or recessed intermittently along its longitudinal length so as to define outer pad mounting surfaces on which are secured generally rectangular resilient pads 212 the outer surfaces of which lie generally in the plane containing the knife cutting edges 164*a*.

The anvil cylinder 144 carries a plurality of longitudinally extending arcuate anvil bars 214 which are circumferentially spaced about the anvil cylinder such that each anvil bar cooperates with a pair of the knife blades 164 during synchronized rotation of the knife and anvil cylinders. Each anvil bar 214 carries a plurality of stripper pins 216 which are spaced apart and extend radially outwardly from the associated anvil bar such that each stripper pin penetrates a resilient pad 212 on the spacer bar 210 and impales a cut strip or chip of the web material as it is severed from the web material by the associated knife blades 164. Each impaled waste strip or chip is carried by the stripper pins to the 6 o'clock position of the anvil cylinder where the waste strip or chip is removed by suitable pin wheels or stripper fingers of known design, such as indicated at 218 in FIG. 7. The removed waste chips may be collected within a suitable receptacle such as a vacuum collector illustrated schematically at 220.

During initial setup of the cutter assemblies 154 on the knife cylinder 148 for a web cutting operation, the spacing between the planar surfaces 156*b* and 162*b* of the block members 156 and 162, respectively, is preferably set at approximately 0.030–0.062 inch through adjustment of the lock nuts 188. When initially setting the lock nuts 188, the hinge block mounting screws 174 are loosened and the hinge block positioned to establish a corresponding spacing between the block surface 156*b* and 162*b* adjacent the hinge block, followed by tightening of screws 174. The geometry of the cutter assemblies is such that the cutting edge 164*a* of each knife blade 164 engages its associated anvil bar 214 approximately 5 degrees before reaching the bottom dead center position, and continues contact with the associated anvil bar until approximately 5 degrees beyond the bottom dead center position. The knife blades and associated anvil bars preferably cooperate to effect approximately 0.025 inch radial inward movement of the knife blades at the bottom dead center position. By supporting the knife blades 164 for pivotal movement about their corresponding pivot axes 166 against the force of the biasing springs 180 and 192, interference between the knife blades and the associated anvil bars is accommodated by pivotal movement of the knife blades with the result that damage to the knife blades upon impacting the anvil bar is substantially eliminated, and significantly longer knife blade life is achieved.

During setup, the spring rate of the various belleville or dish springs 60, 72, 180 and 192 and their number within each stack is selected to provide a predetermined cutting force per unit length of the associated knife blades against the corresponding anvil cylinder or anvil bar. By predetermined selection of the springs 60, 72, 180 and 192, a very precise cutting force may be effected between the knife blades and the anvil cylinder. It has been found that selecting the springs to effect a cutting force between the knife blades and associated anvil cylinder or anvil bar of approximately 600 pounds per linear inch along the knife blades will generally result in a desired cut through the web 16. It will be understood that the cutting force obtained between the knife blades and anvil cylinder may be varied as desired dependant upon the type of web material being cut. As aforedescribed, the number and angular positions of the cutter assemblies 20 and 154 about their respective knife cylinders may be selected to obtain a desired number of transverse cuts through the web 16 during each revolution of the knife cylinder. The positions of the various cutter assemblies about the periphery of the knife cylinders may be readily varied through loosening the cap screws 32. As aforenoted, alternative types of springs, such as coil compression springs, may be employed in place of the belleville springs.

Figure 11:
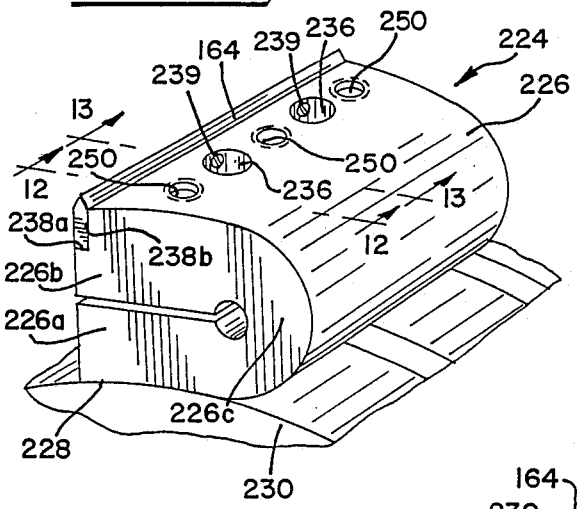
FIG. 11 is a fragmentary perspective view illustrating another embodiment of a cutter assembly in accordance with the invention.
Figure 12:
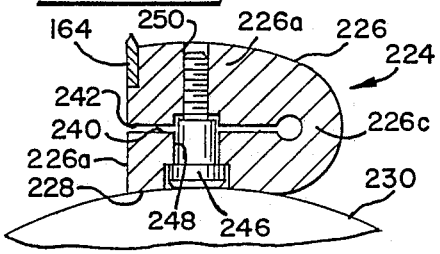
FIG. 12 is a transverse sectional view taken along line 12—12 of FIG. 11.
Figure 13:
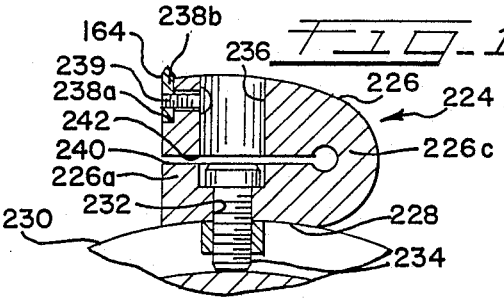
FIG. 13 is a transverse sectional view taken along line 13—13 of FIG. 11.

FIGS. 11–13 illustrate another embodiment of a cutter assembly, indicated generally at 224, which may be adjustably mounted on a knife cylinder, such as the aforedescribed knife cylinders 14 and 148. The cutter assembly 224 also provides a self-adjusting rotary cutter apparatus for use in cutting web material which enables precise control of the cutting force per unit length of knife blade acting against the web during a cutting operation and facilitates quick and precise knife blade replacement. The cutter assembly 224 includes a generally C-shaped housing 226 which defines a first inner block member portion **226*a* and a second outer block member portion 226*b* which is adapted for generally pivotal movement relative to the inner block member portion 226*a* about a longitudinal hinge axis defined by the integral connection 226*c* between the inner and outer housing member portions 226*a* and 226*b*. The inner block member portion 226*a* is preferably formed with an arcuate outer surface 228 of a radius substantially equal to radius of the an associated cylindrical knife cylinder, a portion of which is indicated at 230, on which the cutter assembly 224** is mounted.

A pair of parallel counterbored bores 232 are formed in the housing 226 spaced apart to enable hold-down screws 234 to be inserted into the bores 232 through bores 236 in the upper block member portion **226*b*. The hold-down screws 234 extend into underlying annular dovetail grooves in the knife cylinder 230 for adjustable mounting of one or more cutter assemblies 224 on the knife cylinder in similar fashion to mounting of the cutter assemblies 154**.

A knife blade 164 is mounted on the upper block member portion **226*b* so as to positively engage planar reference surfaces 238*a* and 238*b* which define a rectangular recess formed longitudinally along the upper forward edge or the block member portion 226*b*. The knife blade 164 is releasably retained within the knife mounting recess by screws 239 which are accessible through the bores 236**.

The block member portions **226*a* and 226*b* define mutually facing planar surfaces 240 and 242, respectively, which are normally spaced apart approximately 0.030–0.062 inch. Three preload screws 246 are received upwardly within corresponding counterbores 248 in the block member portion 226*a* and have threaded engagement with taped bores 250 in the block member portion 226*b*. Depending upon the specific material selected for the housing 226, the block member portion 226*b* will provide a predetermined resistance to movement toward the block member portion 226*a* about their hinged connection 226*c*. By selective adjustment of the preload screws 246, the block member portion 226*b* may be drawn toward block member portion 226*a* so as to establish a predetermined preload of the block member portion 226*b*. Further pivotal movement toward the block member portion 226*a* would thus require a predetermined reaction force acting on the knife blade 164**.

Figure 14:
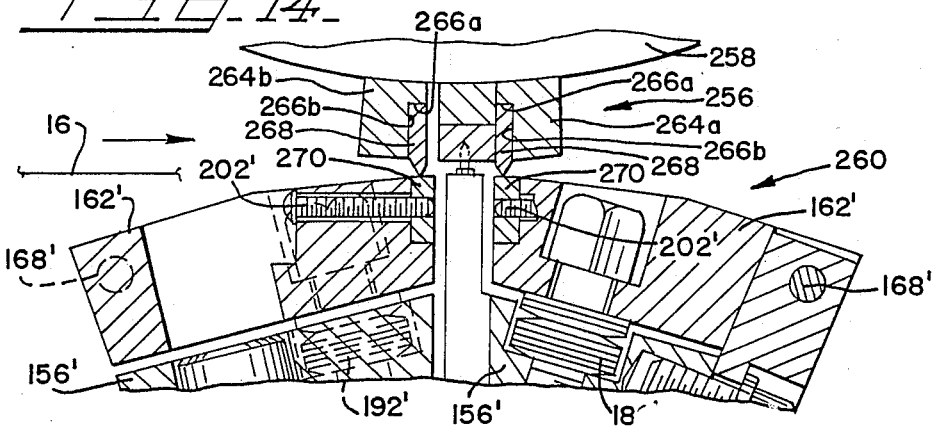
FIG. 14 is a fragmentary sectional view similar to FIG. 9 but showing an alternatively arrangement of cutter assembly elements.

FIG. 14 illustrates a fragmentary portion of an alternative embodiment of a variable rotary cutter apparatus which employs a cutter assembly 256 carried by a rotatable knife cylinder 258. The cutter assembly 256 cooperates with an anvil assembly 260 carried by a rotatable anvil cylinder (not shown) so as to effect transverse cutting of a web material 16 passed between the synchronously rotated knife and anvil cylinders. The cutter assembly 256 includes a pair of knife blade mounting blocks **264*a* and 264*b* which are adjustably mounted on the periphery of the knife cylinder 258 through mounting bolts and dovetail nuts (not shown) similar to the mounting screws 32 and dovetail nuts 36. Each mounting block 264*a,b* has a knife blade mounting recess defined by right angle reference surfaces 266*a* and 266*b* against which a knife blade 268** is releasably secured by suitable attaching screws (not shown).

The knife blades 268 are similar to the knife blades 164 and have outer cutting edges adapted for cooperation with a pair of identical anvil blocks 270 carried by the anvil cylinder during each revolution of the knife and anvil cylinders so as to transversely cut a web material as it is passed through the nip between each knife blade and its corresponding anvil block. The anvil blocks 270 are each mounted on a pivot block member 162' through mounting screws 202' in similar fashion to the aforedescribed mounting of the knife blades 164 on the block member 162 of FIG. 9. The pivot blocks 162' are each pivotally mounted on a corresponding inner block member 156' through a hinge pin 168' and are biased outwardly by belleville springs 180' and 192' in similar fashion to the outward bias of the knife blades 164 on the cutter assemblies 154. The block members 156' are preferably adjustably mounted on the associated anvil cylinder so as to enable selective adjustment for cutting cooperation between the knife blades 268 and the anvil blocks 270. The rotary cutter apparatus of FIG. 14 thus differs from the aforedescribed rotary cutter assemblies by mounting the knife blades in fixed relation on the knife cylinder, and resiliently mounting cooperating anvil blocks on the anvil cylinder in a manner enabling precise adjustment of the cutting force per linear unit length of the knife blades during a web cutting operation.

Thus, in accordance with the invention, selective positioning of one or more rotary cutter assemblies about the periphery of a knife cylinder, and precise attachment and subsequent release and replacement of web cutting knife blades may be readily undertaken by an operator with substantially less skill than required by prior rotary web cutter apparatus. The lower skill level of the operator is further brought about by the ability of the cutter assemblies to be readily and accurately preloaded prior to or after mounting on an associated knife cylinder. Precise preloading, or alternatively, accurate adjustment of the biasing forces acting against the outer block members 26, 162, **226*b* and 162'** allows the knife blades to effectively undergo self-adjustment as the rotary cutter machine characteristics vary throughout operation, such as upon heating of the various components Still further, problems of harmonic vibration created by impacting of the knife blades against the anvil cylinder are substantially eliminated by the cutter assemblies in accordance with the invention, thus allowing substantially higher cutting speeds to be sustained.

While preferred embodiments of the invention have been illustrated and described, it will be understood that changes and modifications may be made therein without departing from the invention in its broader aspects. Various features of the invention are defined in the following claims.

What is claimed is:

1. A cutter assembly for use in a rotary web cutter apparatus having rotatable anvil and knife cylinders supported in parallel spaced apart relation and between which a web material passes during generally transverse cutting or perforating thereof, said cutter assembly comprising a first block member adapted to be mounted on the periphery of the knife cylinder for rotation therewith, a second block member supporting an elongated knife blade thereon and being mounted on said first block member for pivotal movement about a pivot axis parallel to and spaced from said knife blade, and means cooperative with said first and second block members so as to bias said second block member about said pivot axis away from said first block member but enabling pivotal movement of said second block member toward said first block member when said cutter assembly is mounted on the knife cylinder and said knife blade engages the web material against the anvil cylinder, said biasing means being operative to effect a predetermined cutting force between said knife blade and the web during a web cutting operation.

2. A cutter assembly as defined in claim 1 wherein said biasing means comprises spring means interposed between said first and second block members and operative to bias said second block member generally radially outwardly about said pivot axis when the cutter assembly is mounted on the knife cylinder.

3. A cutter assembly as defined in claim 2 wherein said spring means is captured between said first and second block members and is adapted to apply a predetermined cutting force by said knife blade against an anvil cylinder when mounted on a knife cylinder and passed through a nip between the knife blade and anvil cylinder.

4. A cutter assembly as defined in claim 3 wherein said spring means comprises a plurality of belleville type springs.

5. A cutter assembly as defined in claim 3 including means cooperative with said block members so as to enable selective adjustment of the cutting force applied by said knife blade against the anvil cylinder when said cutter assembly is mounted on said knife cylinder.

6. A cutter assembly as defined in claim 5 wherein said adjustment means is adjustable from externally of said cutter assembly when mounted on the knife cylinder.

7. A cutter assembly as defined in claim 2 wherein said spring means is captured between said first and second block members in a manner to prevent access to said spring means when said cutter assembly is mounted on the periphery of a knife cylinder.

8. A cutter assembly as defined in claim 1 further including means cooperative with said first and second block members to limit the extent of outward pivotal movement of said second block member relative to said first block member.

9. A cutter assembly as defined in claim 8 wherein said biasing means comprises annular spring means interposed between said first and second block members, said pivotal movement limiting means including at least one limiting screw coaxial with said annular spring means and cooperative with said first and second block members to limit the extent of outward pivotal movement of said second block relative to said first block member.

10. A cutter assembly as defined in claim 1 wherein said pivot axis is defined by a plurality of spherical balls interposed between said first and second block members and positioned to define said pivot axis spaced from and parallel to said knife blade.

11. A cutter assembly as defined in claim 10 including retaining means cooperative with said first and second block members to resiliently urge said first and second block members into seated engagement with said spherical balls.

12. A cutter assembly as defined in claim 1 wherein said second block member defines a knife receiving reference surface thereon, said knife blade being adapted to engage said reference surface, and including means releasably attaching said knife blade to said second block member.

13. A cutter assembly as defined in claim 1 including a base block adapted for direct mounting on the peripheral surface of a knife cylinder, said base block being adapted to have one or more of said cutter assemblies mounted thereon along its longitudinal length.

14. A cutter assembly as defined in claim 1 wherein said pivot axis is defined by a hinge pin extending longitudinally of said cutter assembly and cooperative with said first and second block members so as to enable relative pivotal movement therebetween.

15. A cutter assembly as defined in claim 14 including a hinge block affixed to one of said first and second block members and defining a longitudinal bore therethrough, said hinge pin extending through said longitudinal bore and being affixed to the other of said first and second block members so as to enable pivotal movement of said other block member about the axis of said bore.

16. A cutter assembly as defined in claim 15 wherein said hinge block is adjustable relative to said one of said first and second block members so as to enable selective spacing between said block members.

17. A cutter assembly as defined in claim 1 wherein said knife blade is mounted on said second block member by means enabling rapid release and replacement of said blade when said cutter assembly is mounted on a knife cylinder.

18. A cutter assembly as defined in claim 1 wherein said first and second block members are integrally connected in a manner to enable said pivotal movement of said second block member about a pivot axis defined by said integral connection.

19. A variable rotary cutter assembly for use in cutting a web material comprising, in combination, a generally cylindrical anvil cylinder, a generally cylindrical knife cylinder, frame means rotatably supporting said anvil and knife cylinders such that their longitudinal axes lie in a common plane and are spaced apart to enable a web material to pass between said anvil and knife cylinders during rotation thereof, and at least one cutter assembly mounted on the peripheral surface of said knife cylinder and including a first block member adapted to be mounted on said knife cylinder, a second block member mounted on said first block member for pivotal movement about a pivot axis parallel to the rotational axis of said knife cylinder, an elongated knife blade carried by said second block member in parallel spaced relation to said pivot axis and defining a cutting edge thereon, and means cooperatively with said first and second block members to bias said second block member pivotally outwardly from said first block member such that said cutting edge engages said anvil cylinder to effect a generally transverse cut through web material passing between said knife and anvil cylinders during rotation thereof.

20. A rotary cutter assembly as defined in claim 19 wherein said biasing means comprises spring means interposed between said first and second block members and biasing said second block member generally radially outwardly relative to said first block member.

21. A rotary cutter assembly as defined in claim 20 including means operatively associated with said first and second block members so as to enable selective control of the biasing force acting to effect outward pivotal movement of said second block member relative to said first block member.

22. A rotary cutter assembly as defined in claim 19 wherein said pivot axis is defined by a hinge pin pivotally interconnecting said first and second block members.

23. A rotary cutter assembly as defined in claim 22 wherein said biasing means comprises spring means interposed between said first and second block members in a manner to establish a predetermined cutting force between said knife blade and said anvil cylinder during a web cutting operation.

24. A rotary cutter assembly as defined in claim 19 including at least one pair of said cutter assemblies mounted in symmetrical opposed relation on the periphery of said knife cylinder so as to define a pair of parallel knife blades operative to sever a web along parallel cut lines upon rotation of said knife cylinder whereby to create a trim strip between said knife blades.

25. A rotary cutter assembly as defined in claim 24 including stripper means operative to impale said trim strip and remove it from said knife cylinder during rotation of said knife cylinder.

26. A rotary cutter assembly as defined in claim 25 wherein said stripper means includes a plurality of stripper pins operative to impale said trim strip during cutting of said web material, and means cooperative with said stripper pins in a manner to remove said trim strip therefrom.

27. A rotary cutter assembly as defined in claim 26 wherein said stripper pins are interposed between said knife blades, and including a stripper bar cooperative with said stripper pins and extending outwardly beyond at least one end of said knife cylinder, and cam actuator means operative to effect radially outward movement of said stripper bar relative to said stripper pins so as to eject a trim strip carried on said stripper pins during rotation of said knife cylinder.

28. A rotary cutter assembly as defined in claim 27 wherein said stripper means includes means biasing said stripper bar to a first radially inward position relative to said stripper pins, said cam actuator means being operative to move said stripper bar radially outwardly relative to said stripper pins to eject a trim strip therefrom during rotation of said knife cylinder.

29. A rotary cutter assembly as defined in claim 25 wherein said stripper means includes a plurality of stripper pins carried by said anvil cylinder and operative to impale a trim strip as it is severed from said web during rotation of said knife cylinder.

30. A rotary cutter assembly as defined in claim 19 wherein said second block member defines a reference surface for engagement with said knife blade, and means releasably securing said knife blade against said reference surface.

31. A rotary cutter assembly as defined in claim 30 wherein said blade securing means includes at least one hold-down screw accessible to effect release of said knife blade without removing the cutter assembly from said knife cylinder.

32. A variable rotary cutter assembly for use in cutting a web material comprising, in combination, a generally cylindrical anvil cylinder, a generally cylindrical knife cylinder, frame means rotatably supporting said anvil and knife cylinders such that their longitudinal axes lie in a common plane and are spaced apart to enable the web material to pass therebetween during rotation of said anvil and knife cylinders, at least one cutter assembly mounted on the peripheral surface of said knife cylinder and including at least one knife blade defining a cutting edge generally parallel to the rotational axis of said knife cylinder, and anvil means mounted on said anvil cylinder for cooperation with said knife blade during rotation of said knife and anvil cylinders, said anvil means including a first block member supported on said anvil cylinder, a second block member mounted on said first block member for pivotal movement about a pivot axis parallel to the rotational axis of said anvil cylinder, an anvil block carried by said second block member for engagement with said knife blade during rotation of said knife and anvil cylinders, and means operative to resiliently bias said second block member generally radially outwardly from said first block member so as to resiliently engage said anvil block against said cutting edge to effect a generally transverse cut through web material passing between said knife and anvil cylinders during rotation thereof.

33. A cutter assembly for use in a rotary web cutter apparatus having rotatable anvil and knife cylinders supported in parallel spaced apart relation and between which a web material passes during generally transverse cutting or perforating thereof, said cutter assembly comprising a first block member adapted to be mounted on the periphery of the knife cylinder for rotation therewith, a second block member formed integral with said first block member and supporting an elongated knife blade thereon, said first and second block members being pivotally movable relative to each other about a pivot axis parallel to and spaced from said knife blade, said block members being made from a material operative to bias said second block member to a predetermined position relative to said first block member but enabling pivotal movement of said second block member toward said first block member when said cutter assembly is mounted on the knife cylinder and said knife blade engages the web material against the anvil cylinder, and means interconnecting said first and second block members in a manner to enable selective adjustment of said second block member relative to said first block member so as to effect a predetermined cutting force between said knife blade and the web without inhibiting said pivotal movement of said second block member toward said first block member when said knife blade engages the web material against the anvil cylinder during a web cutting operation.

34. A cutter assembly as defined in claim 33 wherein said selective adjustment means includes at least one preload screw interconnecting said first and second block members and operative to enable adjustment of the pivotal relation therebetween.

35. A cutter assembly as defined in claim 33 wherein said first and second block members are defined by a generally C-shaped housing adapted to be releasably mounted on the knife cylinder.

36. A cutter assembly as defined in claim 35 wherein said second block member has a longitudinal recess formed along a free marginal edge thereof, said elongated knife blade being mounted within said recess and defining a cutting edge extending outwardly from said housing when mounted on the knife cylinder.

* * * * *